US006952939B2

(12) United States Patent
Lonati et al.

(10) Patent No.: US 6,952,939 B2
(45) Date of Patent: Oct. 11, 2005

(54) APPARATUS AND METHOD FOR CONTROLLING THE WEIGHT OF FABRIC PRODUCED BY A TEXTILE MACHINE, IN PARTICULAR BY A CIRCULAR KNITTING MACHINE

(75) Inventors: Tiberio Lonati, Brescia (IT); Marchina Giuseppe, Rodengo Saiano (IT)

(73) Assignee: Santoni, SpA, Brescia (IT)

( * ) Notice: Subject to any disclaimer, the term of this patent is extended or adjusted under 35 U.S.C. 154(b) by 190 days.

(21) Appl. No.: 10/168,609

(22) PCT Filed: Dec. 22, 2000

(86) PCT No.: PCT/IT00/00544

§ 371 (c)(1),
(2), (4) Date: Jun. 24, 2002

(87) PCT Pub. No.: WO01/48288

PCT Pub. Date: Jul. 5, 2001

(65) Prior Publication Data

US 2003/0000054 A1 Jan. 2, 2003

(30) Foreign Application Priority Data

Dec. 24, 1999 (IT) ..... BS99A0120

(51) Int. Cl.[7] ..... D04B 35/10
(52) U.S. Cl. ..... 66/153; 66/152
(58) Field of Search ..... 66/149 R, 150, 66/152, 151, 153; 242/415; 139/310, 108, 304, 307, 311, 308

(56) References Cited

U.S. PATENT DOCUMENTS

| | | | | |
|---|---|---|---|---|
| 3,590,907 A | * | 7/1971 | Vilen | 242/564.5 |
| 3,604,649 A | * | 9/1971 | Dorfel | 242/541.6 |
| 3,973,599 A | * | 8/1976 | Pfarrwaller | 139/304 |
| 4,227,554 A | * | 10/1980 | Volland | 139/310 |
| 4,888,963 A | * | 12/1989 | Scherzinger et al. | 66/151 |
| 5,022,597 A | * | 6/1991 | Morizzo | 242/413.5 |
| 5,566,558 A | * | 10/1996 | Tsuchiya | 66/151 |
| 5,586,581 A | * | 12/1996 | Suwa | 139/304 |
| 5,611,500 A | * | 3/1997 | Smith | 242/541.4 |

* cited by examiner

*Primary Examiner*—Danny Worrell
(74) *Attorney, Agent, or Firm*—James Conte; Barnes & Thornburg

(57) ABSTRACT

An apparatus (1) is provided to control the weight of fabric produced by a textile machine (2), comprising weighting means (11) of every single fabric piece directly associated to the textile machine dedicated to the manufacture of the same. A procedure is also provided to control the weight of the fabric produced by a textile machine comprising a weighting stage of every single fabric wounded or folded, near the textile machine dedicated to the manufacture of said piece, and to apply to every manufactured piece a printed label suitable to provide at least specific data concerning the piece weight.

9 Claims, 8 Drawing Sheets

APPARATUS AND METHOD FOR CONTROLLING THE WEIGHT OF FABRIC PRODUCED BY A TEXTILE MACHINE, IN PARTICULAR BY A CIRCULAR KNITTING MACHINE

BACKGROUND OF THE INVENTION

The object of the present invention is an apparatus and method for controlling the weight of fabric produced by a textile machine, in particular by a circular textile machine.

As is known, textile machines, and in particular circular knitting machines for manufacturing knitted fabrics, are generally provided with a pick-up unit for the produced fabric piece, said unit being equipped, beyond with suitable traction rolls, with a winding roll in case the piece is picked up in rolls, or with a cloth folder in case said piece is picked up in laps.

In the case of circular knitted machines the pick-up unit consists of a structure turning integrally with the cylinder or needle bed placed above it together with the stretching rolls positioned upstream from said pick-up unit. The rotary motion of the stretching and pick-up unit and of the needle bed usually consists of a mechanical unit or, in more recent times, said motion is driven by an electric motor enslaved in its turn with an electronic unit controlling the correct working of every portion of the textile machine.

Since all the fabric pieces, either folded into rolls or piled up in laps, coming out of a knitting mill and successively sent to other departments or factories for finishing or dyeing operations must be assigned their effective weight, it is provided in the prior art to weigh each individual piece in a suitable weighing department.

In practice, some pieces produced by a given textile machine are piled up beside said machine and then periodically picked up and conveyed together with other groups of pieces coming from other machines to the weighing department, in which the weight of each piece is written down directly onto an edge of the fabric or on a card which should obviously be attached to the weighed piece.

Moreover, the weight of each piece should then be written down onto a summary form.

The weighing process briefly described above shows a number of disadvantages.

First of all, pieces have weights which can strongly vary with respect to the foreseen values, since the evaluation of the weight of a given piece during its production is generally carried out on the basis of the number of revolutions made by the knitting machine during its manufacture. According to the moisture degree, to the kind of yarn and to the knitted structure, highly different weights having the same number of revolutions and sometimes even going beyond the admissible tolerance field can correspond.

In addition, technical times directly required for the detection of the weight of fabric pieces and times required for their conveyance to the weighing departments are quite long.

The specific personnel is therefore partially diverted from carrying out more specifically manufacturing operations connected with the working of textile machines.

It should be observed that the conveyance and storing in the same place of several pieces coming from different machines can easily involve an exchange between similar pieces assigning to them features, such as the kind of yarn and the batch of raw materials used, which do not correspond to the actual features, thus clearly creating problems in the handling of the produced fabrics.

It should eventually be pointed out that the practice to put an indelible mark directly onto an edge of the fabric, which cannot therefore be used, can involve high economic losses in the case of valuable textile fibers.

In this situation the technical purpose of the present invention is to provide an apparatus and a method for controlling the weight of fabric produced by a textile machine which can substantially overcome the above-mentioned disadvantages.

Within said technical purpose an important aim of the invention is to provide an apparatus and a method allowing to obtain at the output of the textile machines wound or folded fabric pieces showing—with an extremely reduced tolerance field—a pre-established weight, independently from the kind of yarn, and therefore to reach for Instance high degrees of homogeneity of the unfinished products which should then undergo finishing or dyeing operations. Another important aim of the invention is to provide an apparatus and a method allowing to assign with certainty to every piece of manufactured fabric not only its actual weight, but also every other information which could be useful to distinguish it, such as the kind of yarn, the presence of possible defects due to machine stops, and the moisture degree at which the fabric-building process took place, thus avoiding information exchanges among the various fabric pieces due to operators' faults or other reasons.

SUMMARY OF THE INVENTION

A further aim is to provide an apparatus and a method showing the weight of a given fabric piece immediately at the end of its manufacturing process, thus eliminating dead times required in the prior art because of the weighing operations.

The technical purpose and the aims indicates are substantially reached by means of an apparatus and a method for controlling the weight of fabric produced by a textile machine, characterized in that they comprise one or more technical solutions claimed below.

BRIEF DESCRIPTION OF THE DRAWINGS

The description of some preferred though not exclusive embodiments of an apparatus for controlling the weight of fabric produced by a textile machine according to the invention is now disclosed as a mere non-limiting example, as shown in the enclosed drawings, in which.

DESCRIPTION OF THE PREFERRED EMBODIMENTS

Figure 1:
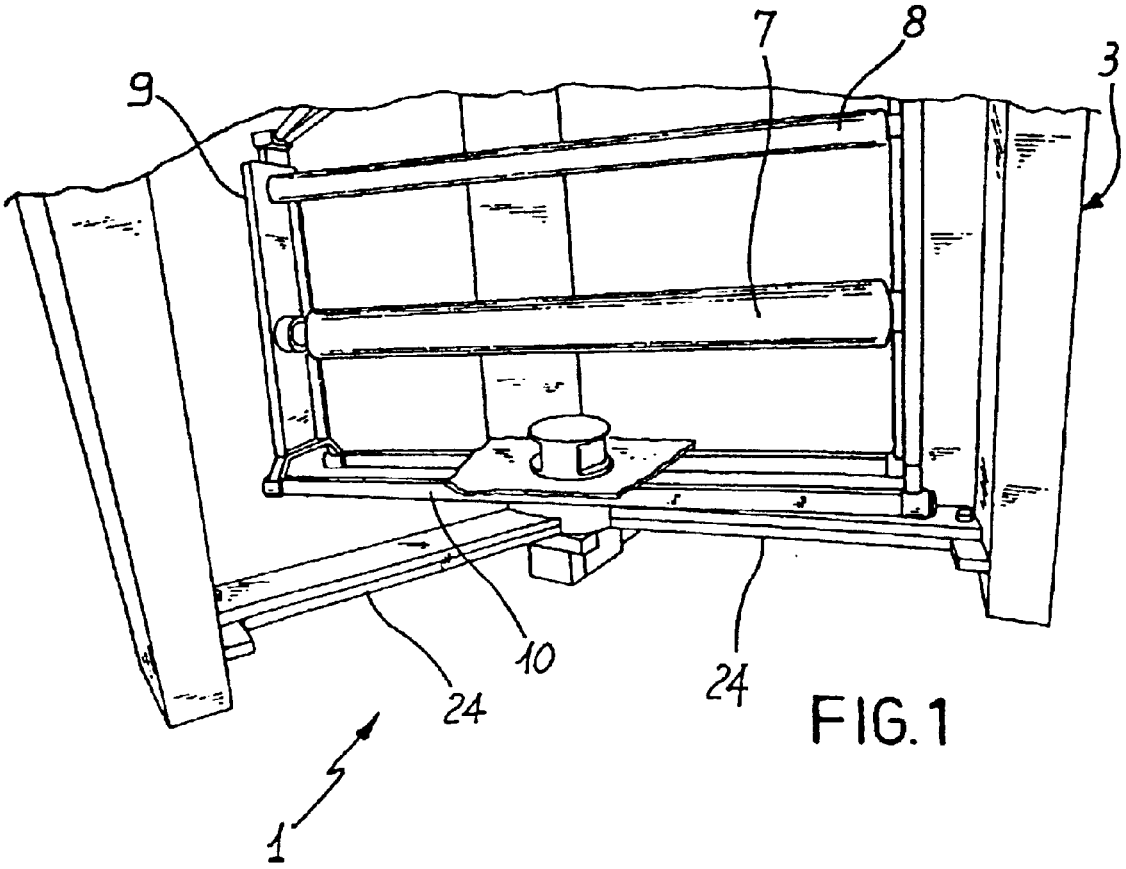
FIG. 1 shows a perspective view of a first apparatus according to the invention associated with a circular textile machine, the latter being only partially represented.

With reference to the figures mentioned above, the apparatus for controlling the weight according to the invention is generally indicated with the numeral 1.

Said apparatus is installed on a textile machine 2, and in particular on a circular knitting machine, comprising a fixed structure 3 under which at least one needle bed 5 is turnably mounted around a vertical axis 4, said needle bed 5 consisting for instance of a cylinder and/or dial turning around stationary cans or vice versa.

A pick-up unit 6 for the fabric piece is placed under the needle bed 5, said group being equipped with a winding roll 7, in case the piece is wound into rolls, or with a cloth folder.

The fabric piece is dragged towards the winding roll 7 by at least a traction roll 8.

The pick-up unit 6 can turn around the vertical axis 4 integrally with the needle bed 5 to which it is connected by means of arms 6*a*, and it comprises a pair of pillars 9 laterally placed, joined in their lower portions by a pair of parallel bars 10 defining their base.

Figure 3:
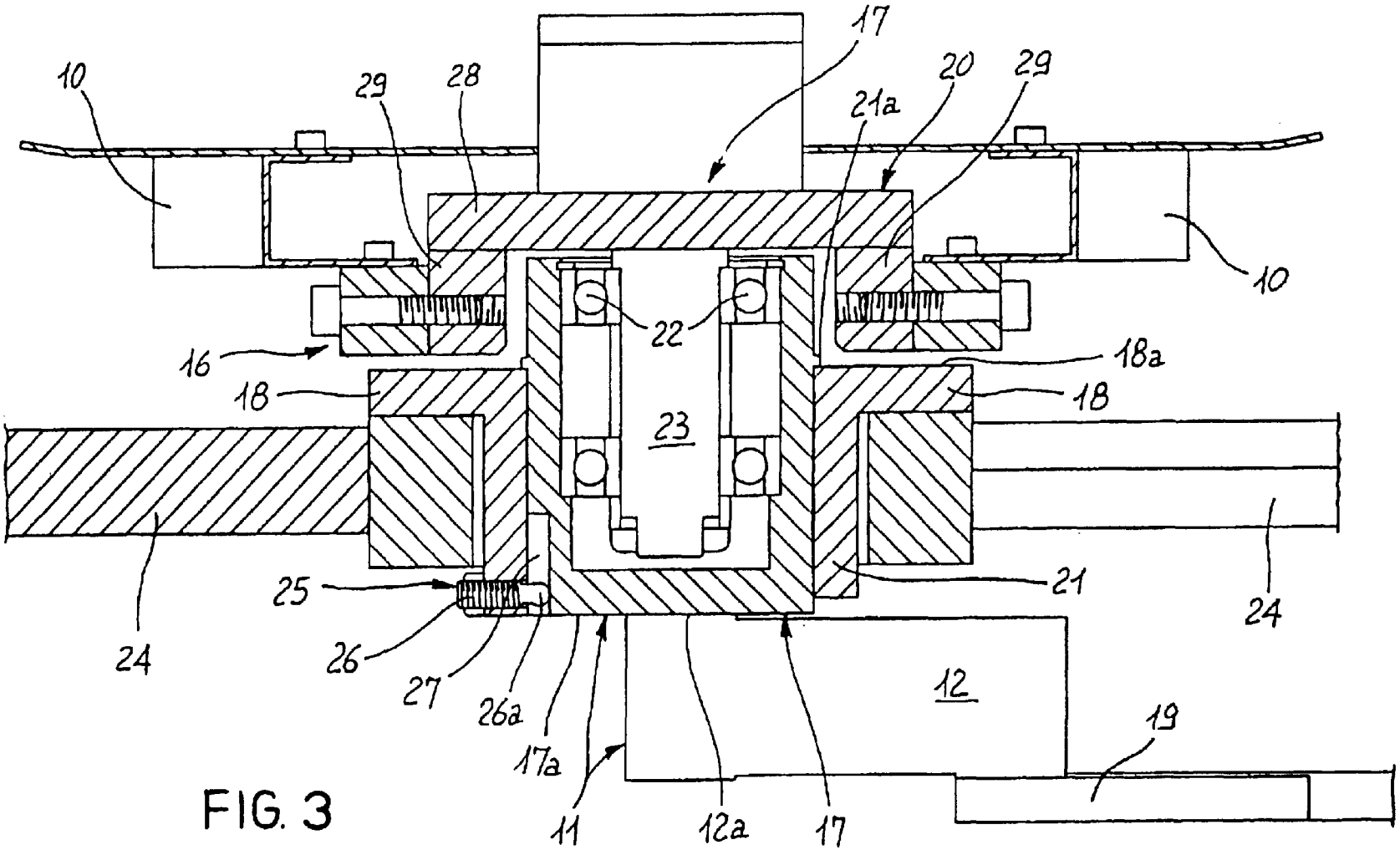
FIG. 3 is a detail of an enlarged vertical section of the apparatus shown in FIG. 1.

In an original way the apparatus for weight control 1 comprises weighing means 11 (FIGS. 3 and 5) adapted to weigh every single fabric piece and directly associated with the textile machine for the manufacture of said piece.

The weighing means comprise in their turn a weight sensor 12, for instance a load cell, adapted to continuously detect the weight reached by said piece during its manufacturing process and when wound in rolls or laps.

Figure 10:
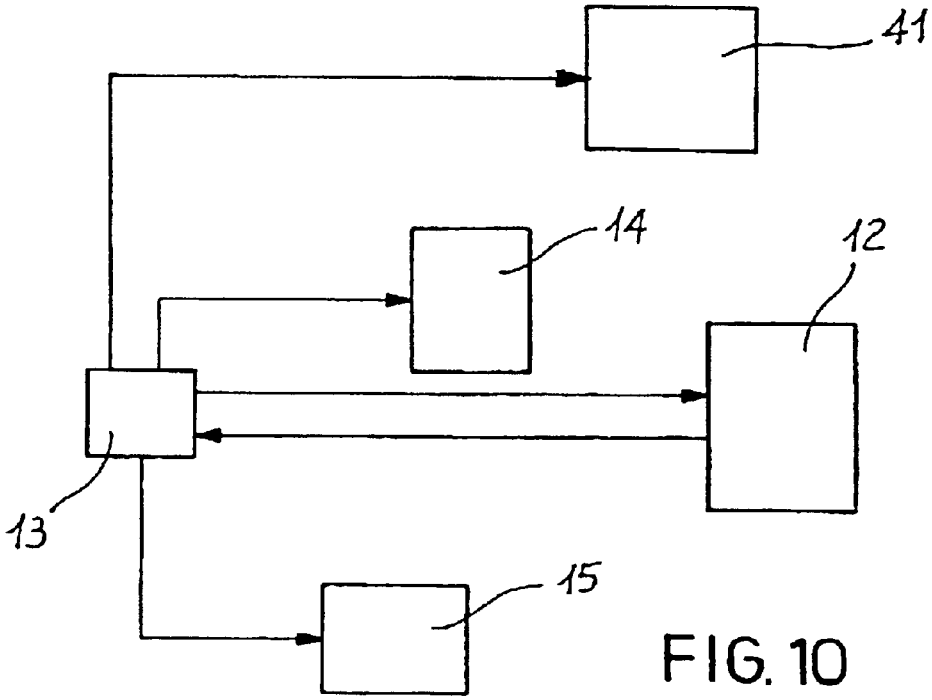
FIG. 10 shows a block diagram of an apparatus for controlling the weight and of some parts of a textile machine operatively connected to said apparatus.
Figure 2:
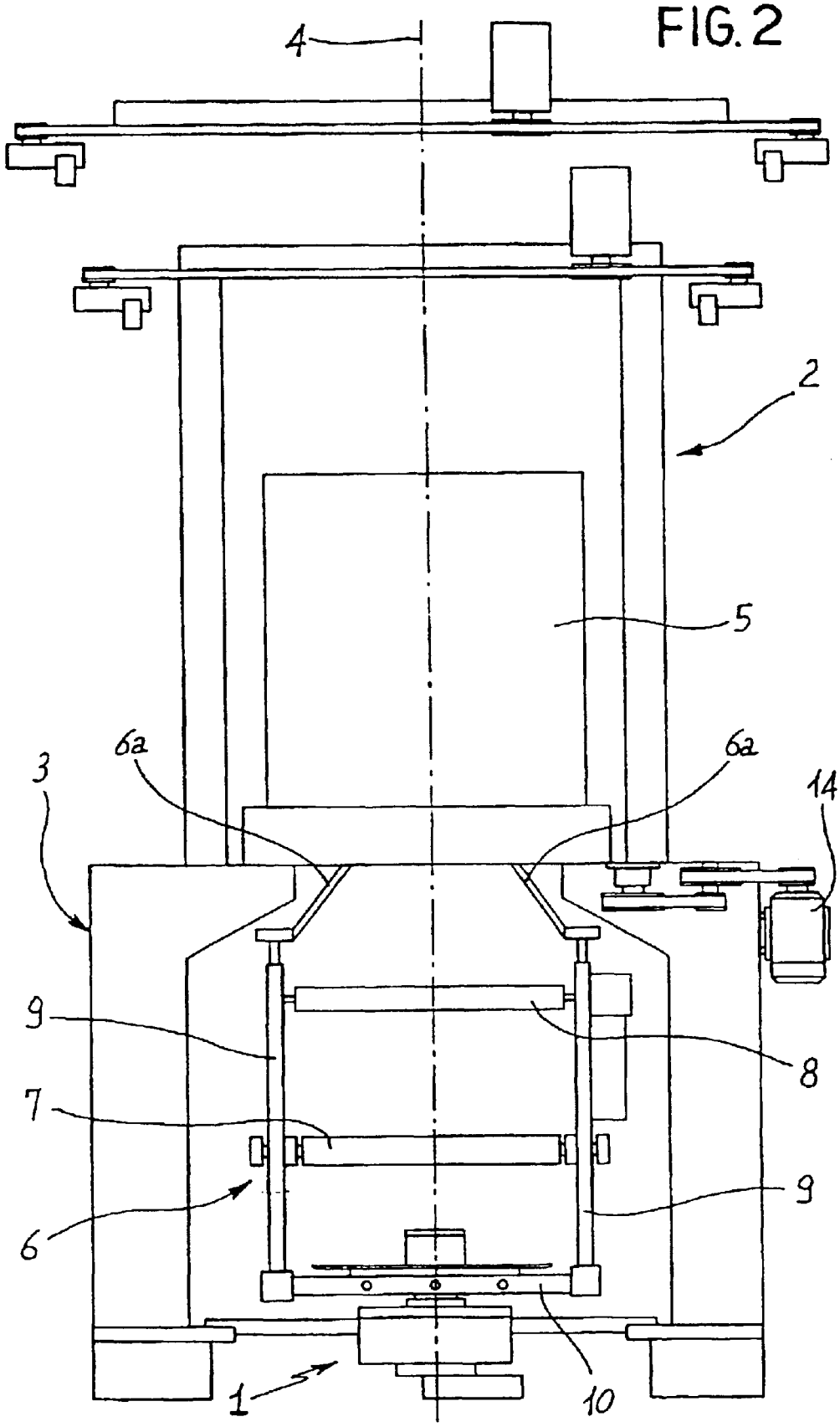
FIG. 2 shows a front view of the apparatus and of the machine shown in FIG. 1.

The weight sensor 12 is operatively connected to an electronic control group 13 (FIG. 10), for instance a PLC, which can check the overall working of the textile machine 2 and in particular of a main electric motor 14 controlling the rotation of the needle bed 5 and the pick-up unit 6. The electronic control group 13 is advantageously connected, or at least put into communication, with a printer 15 producing self-adhesive labels containing at least the information referring to the weight measured by the weight sensor 12. Moreover, a display 41 showing the operator the progression of the measured-weight may be provided. According to a first embodiment shown in FIGS. 1, 2 and 3, the weighing means 11 comprise, beyond the load cell 12, a support unit 16 formed by a vertically sliding portion 17 and by a fixed base 18 defining a guide for said sliding portion 17.

The latter supports the pick-up unit 6 and shows a portion 17*a* operatively contacted with a flexible wall 12*a* of the weight sensor 12 which is integral in its lower portion with a base plate 19 connected in its turn with the fixed structure 3.

Thus, introducing suitable joints into the arms 6*a* connecting the needle bed 5 with the pick-up unit 6 in order to avoid that the weight of the needle bed is transmitted onto said group, the weight sensor 12 detects a load including the weight of said pick-up unit 6, which represents the tare, and the weight of the fabric wound onto the winding roll 7.

The vertically sliding portion 17 comprises a support base 20 connected with the pick-up unit 6 and therefore turning integrally with said unit and with the cylinder or needle bed 5, a slide 21 slidably connected in vertical direction with the fixed base 18, and turning coupling means 22 placed between a vertical support shaft 23, constituting a lower extension of the support base 20, and said slide 21. The turning coupling means 22 consist of rolling-contact bearings supporting the axial load undergone by the vertical shaft 23.

More to the point, the slide 21 is defined by a substantially glass-shaped cylindrical element housing the vertical shaft 23 and turning coupling means 22 and showing a bottom wall defining said portion 17*a* operatively contacted with the load cell 12.

The fixed base 18 comprises a substantially bush-shaped element 24, integral with ledges 24 of the fixed structure 3 and slidably coupled with the slide 21 so that the central axis of said slide 21 and therefore the axis of the vertical shaft 23 coincide with the vertical axis 4 of the cylinder or needle bed 5.

Between the fixed base 18 and the slide 21 anti-turning means 25 are provided, said means including a threaded plug 26 introduced into a radial hole of the fixed base 18 and showing a head 26*a* housed in a vertical groove 27 of the slide 21.

The slide 21 shows on its outer side a ring-shaped abutment extension 21*a* abutting against an upper edge 18*a* of the bush-shaped element 18 so as to define a lower run end for the vertical translation of the slide 21.

The abutment extension 21*a* is normally detached of some millimeters from said upper edge 18*a* so as to allow the slide 21 to unload its weight onto the load cell 12.

The above-mentioned support base 20 comprises a circular plate 28 integral in its lower portion with the vertical shaft 23 and a pair of elongated elements 29 peripherally welded to the circular plate 28.

Said elongated elements 29 are connected with the parallel bars 10 defining the base of the pick-up-unit 6.

Figure 4:
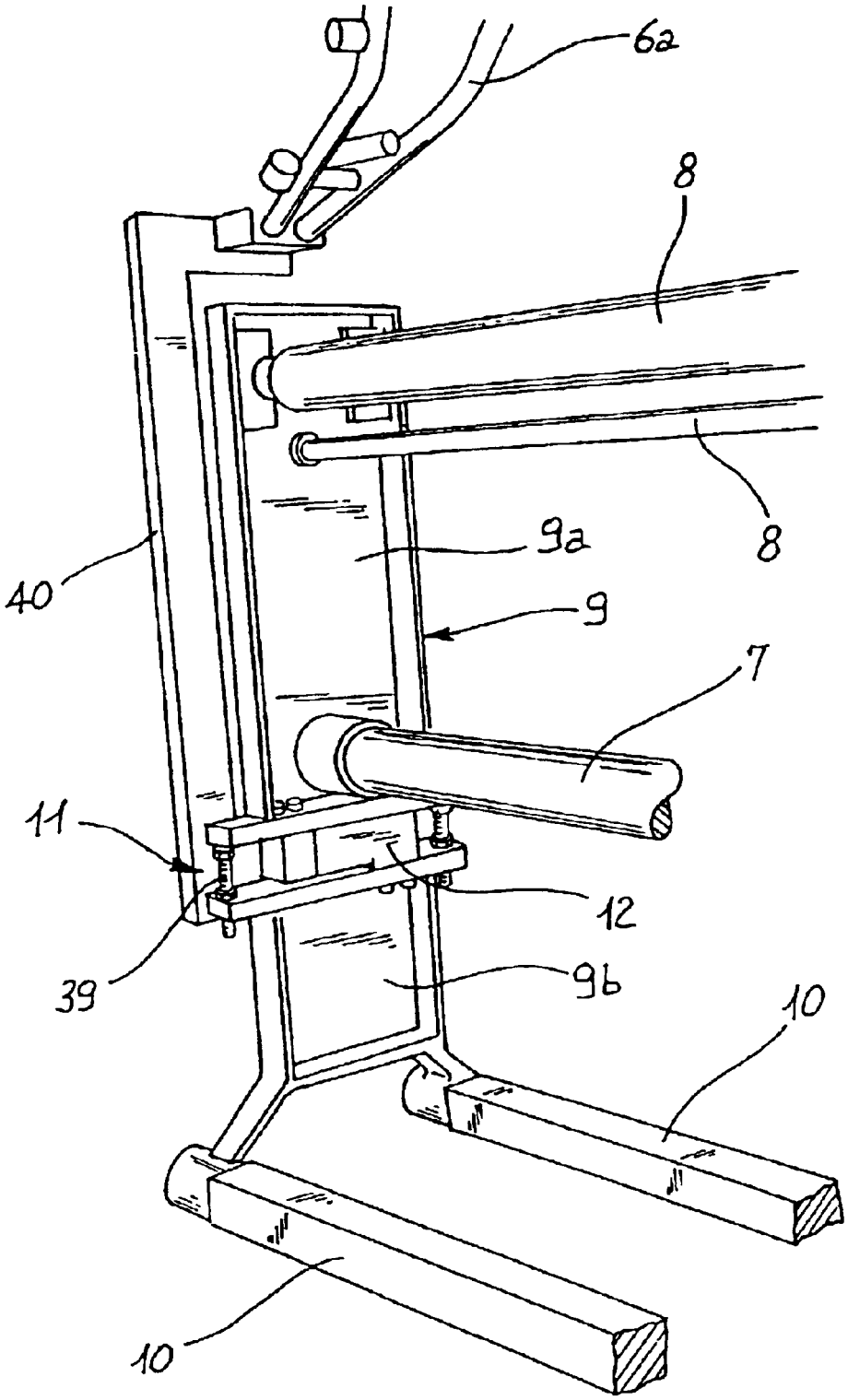
FIG. 4 is a broken perspective view of a second embodiment of an apparatus according to the invention associated with a textile machine, the latter being only partially represented.

According to a second embodiment of the present invention shown in FIGS. 4, 5 and 6, the apparatus for the weight control 1 is placed along the pair of pillars 9, below the end supports of the winding roll 7 or of the cloth folder. As can be seen in FIG. 4, each pillar 9 is divided into two portions, an upper portion 9*a* and a lower portion 9*b*. The end supports of the winding roll 7 are mounted onto the upper portions 9*a*, in the same way as the traction rolls 9. The lower portion 9*b* is integral in its lower part with the pair of parallel bars 10 and it is connected in its upper part to the arms 6*a* by means of a support 40.

Figure 5:
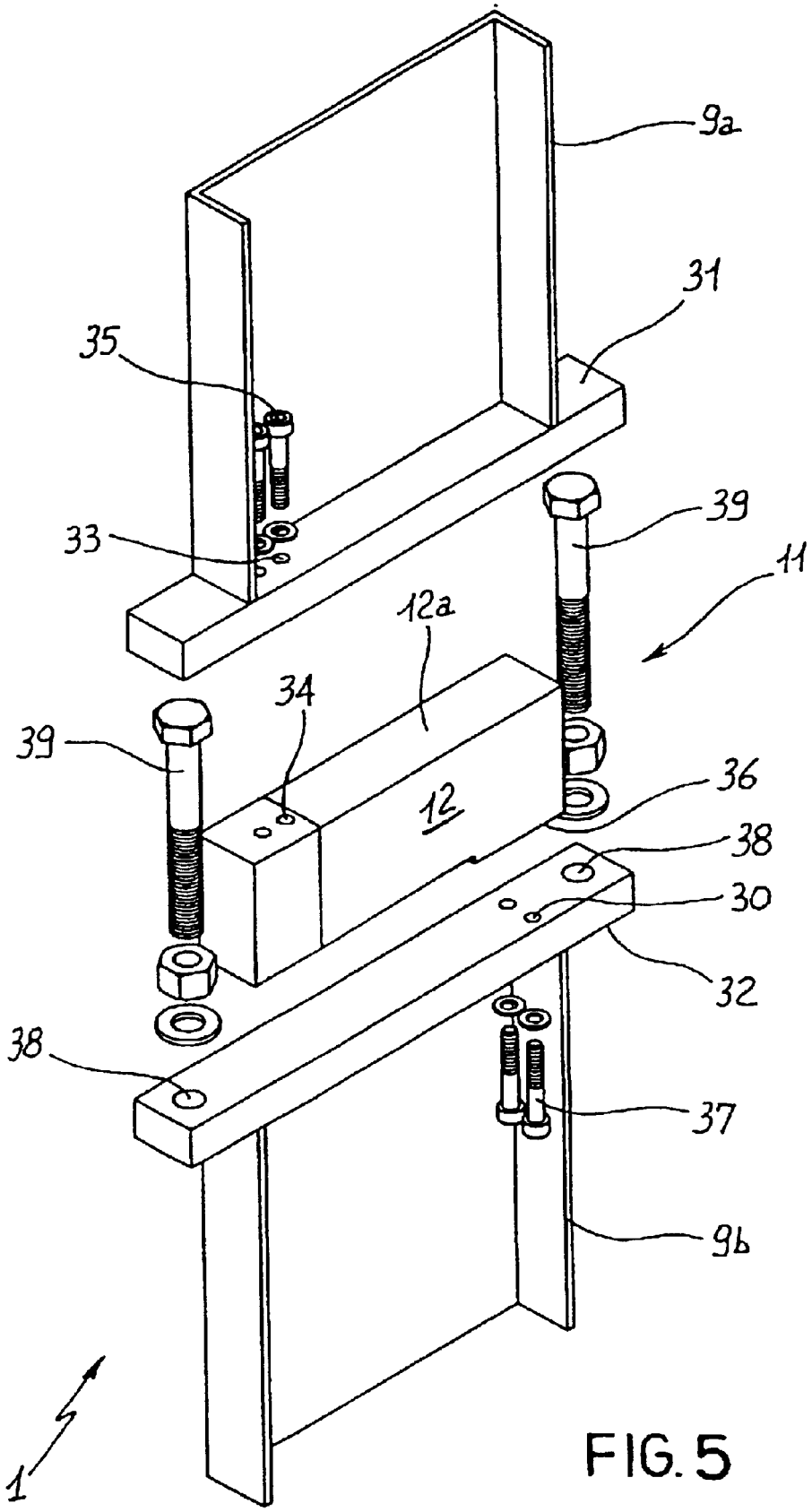
FIG. 5 shows an exploded detail of the apparatus shown in FIG. 4.
Figure 6:
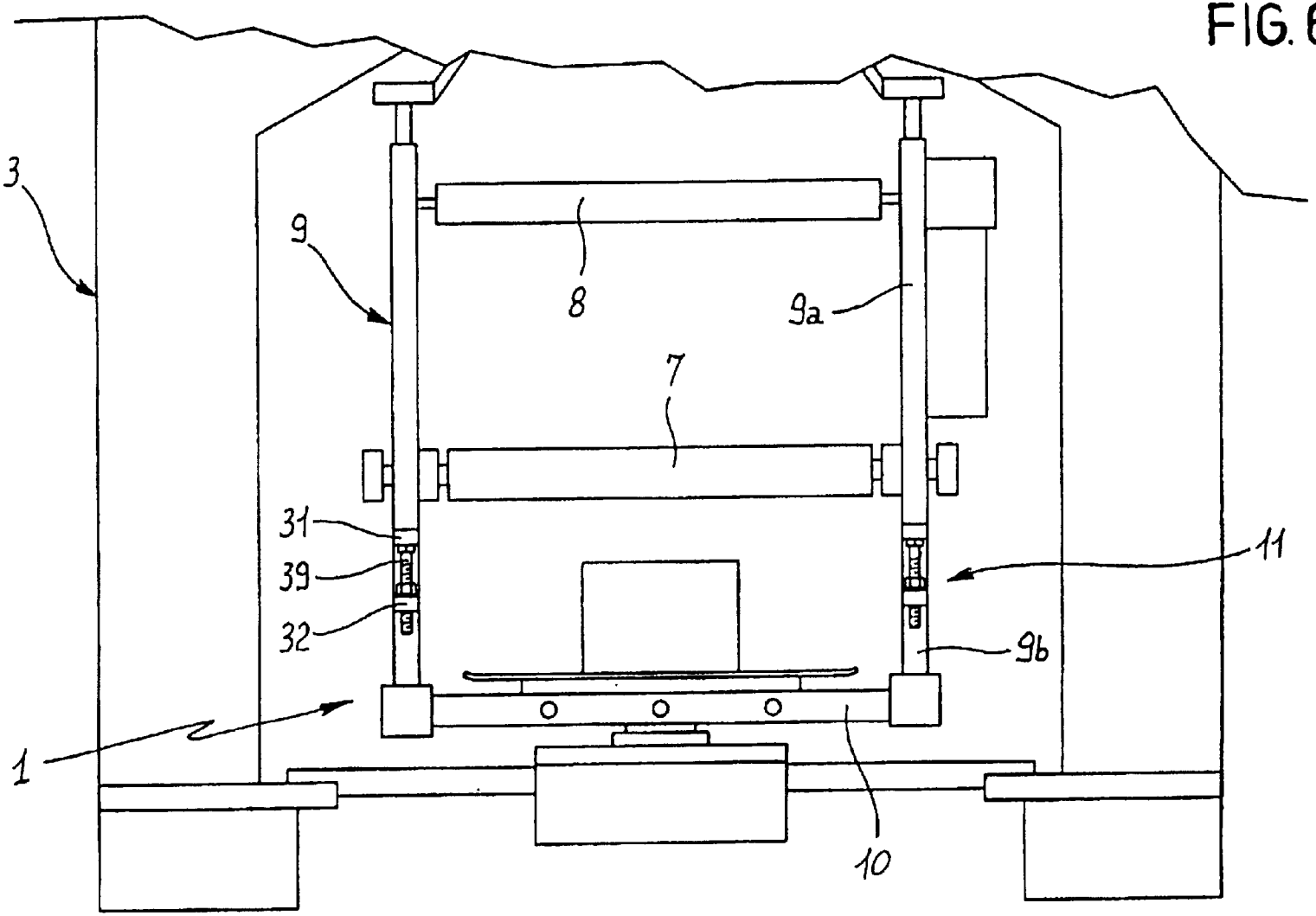
FIG. 6 shows a front view of the apparatus and of the machine shown in FIG. 4.

As shown in FIG. 5, the weighing means 11 of the apparatus for weight control 1 are placed as a connection of each upper portion 9*a* with the corresponding lower portion 9*b*. In this case two weight sensors or load cells 12 are preferably provided, said sensors or cells being operatively mounted between said portions 9*a* and 9*b* so as to enable weight measurement of the first portion 9*a*, of the traction rolls 8, of the winding roll 7 and of the picked up piece. Each load cell 12 carries out an independent weight measurement. Weight can therefore be detected by only one load cell.

The load cell 12 is fixed in its lower portion with an upper end 32 of the lower portion 9*b*, for instance by means of at least a first screw 37 engaged into at least a first through hole 30 of the upper end, and into at least a first blind hole 36 in the load cell 12.

In its upper portion the cell shows a flexible wall 12*a* integral with a lower end 31 of the upper portion 9*a*, for instance by means of at least a first screw 35 engaged into at least a second through hole 33 of the lower end 31, and into at least a second blind hole 34 in the load cell.

It is also provided for a support element 39, consisting for instance of a support bolt engaged into a third hole 38 on the upper end 32 of the lower portion 9*b*. Said support is not usually in contact with the lower end 31, but it supports the upper portion 9*a* when the load to be measured is over a certain safety value beyond which the load cell 12 could be damaged. The support 39 acts in practice as a run end.

Figure 7:
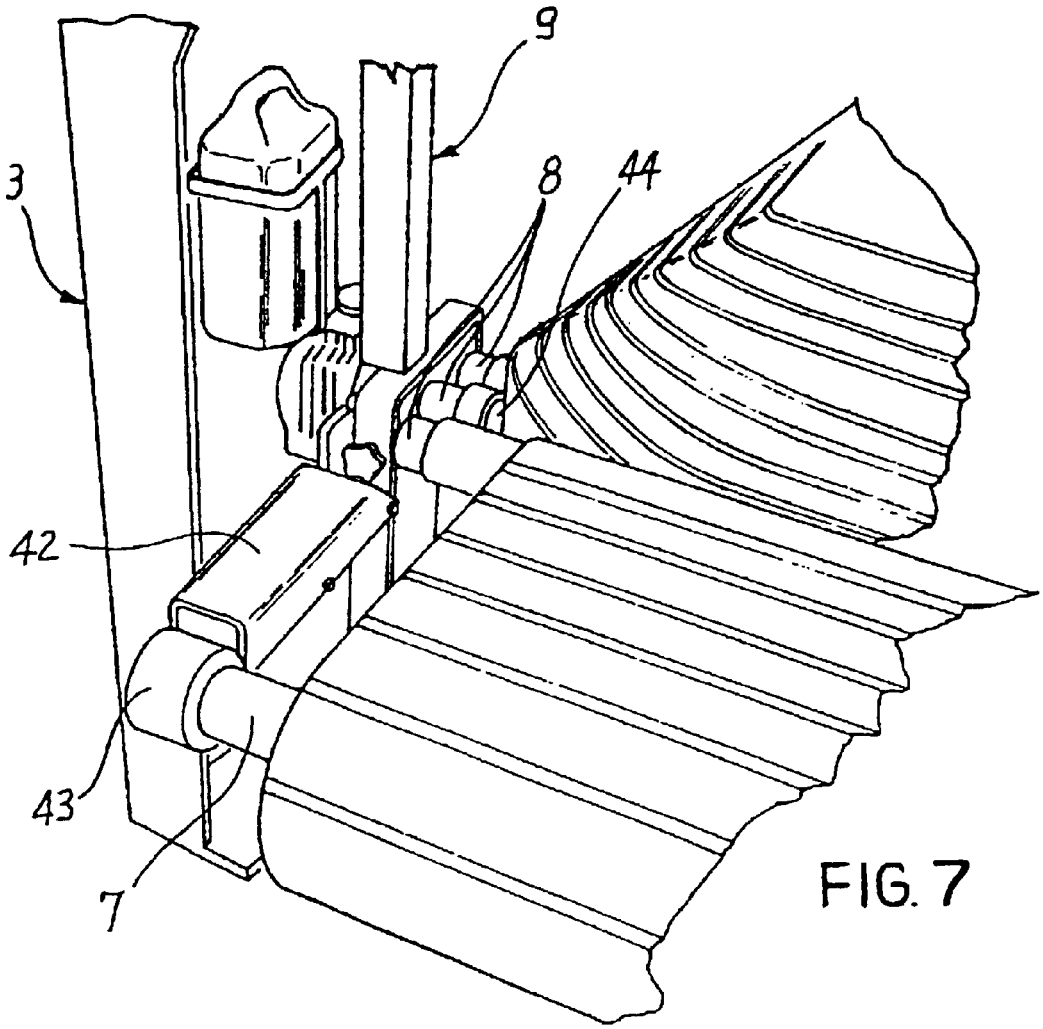
FIG. 7 shows a broken perspective view of a preferred embodiment of an apparatus according to the invention associated with a textile machine, the latter being only partially represented.
Figure 8:
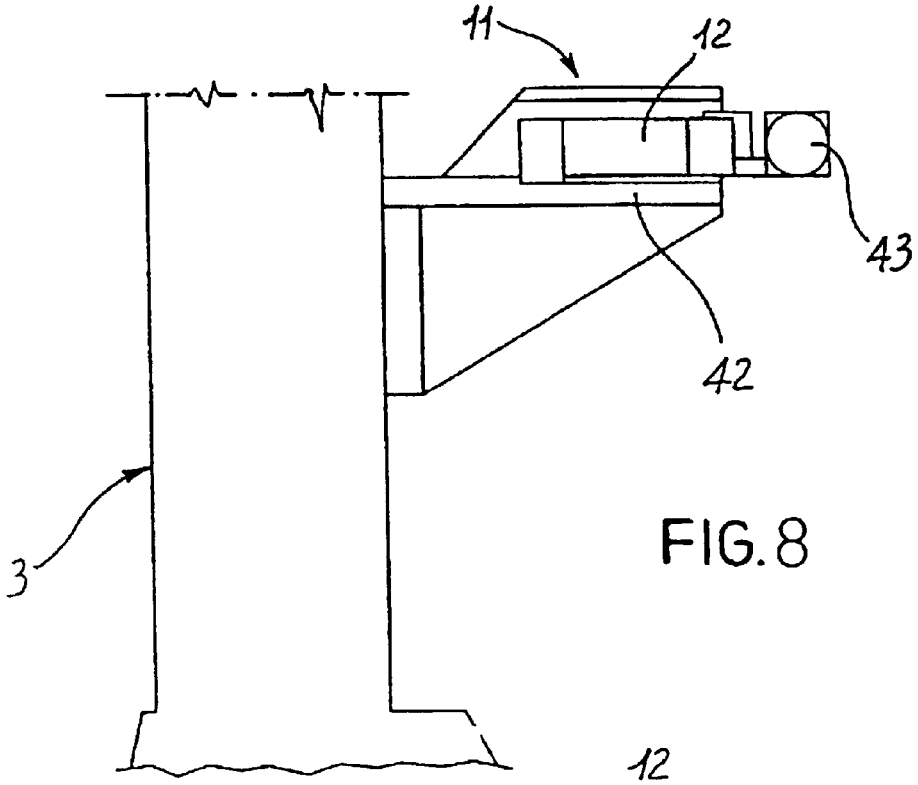
FIG. 8 shows a left lateral view of the apparatus shown in FIG. 7.
Figure 9:
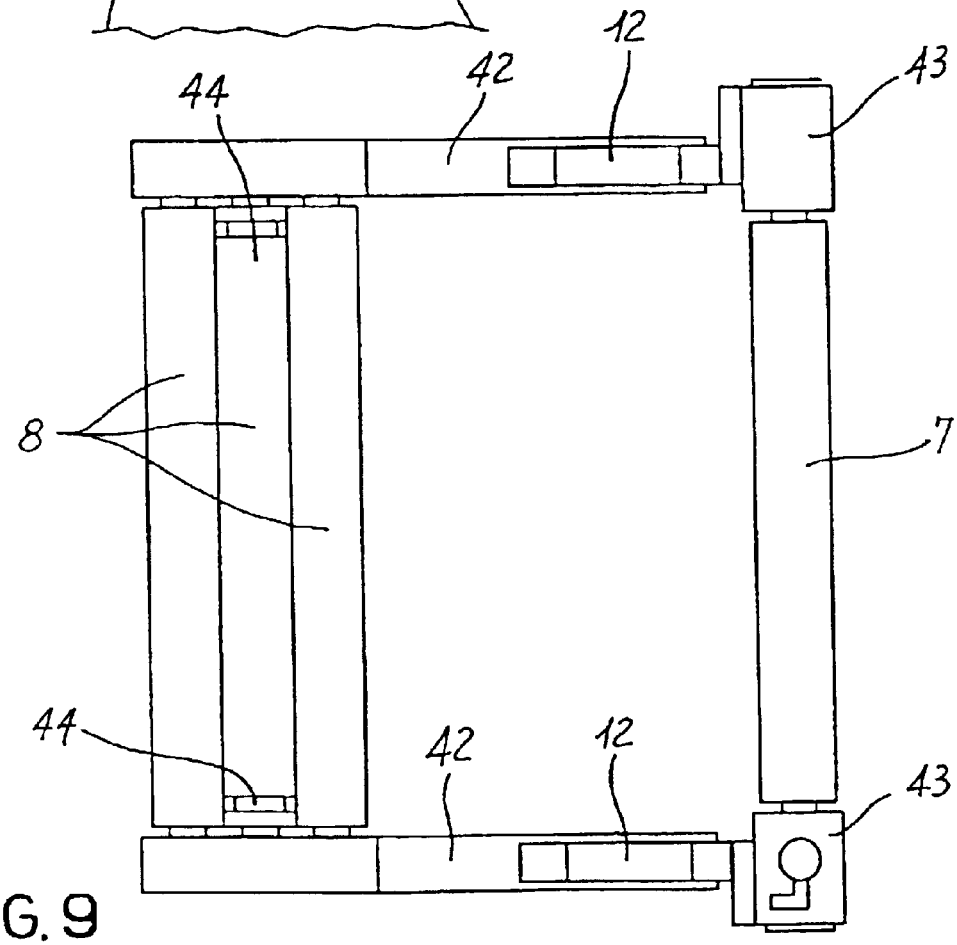
FIG. 9 shows a top view of the apparatus shown in FIG. 7.

According to a preferred embodiment of the present invention shown in FIGS. 7, 8 and 9, the apparatus for weight control 1 is placed in a protruding position outside the machine, by means of a pair of support arms 42 extending from the pair of pillars 9 respectively. Both support arms 42 house the weighing means 11, advantageously carried out by means of load cells 12.

The end supports 43 of the winding roll 7 or of the cloth folding rest on both load cells 12, so as to allow said cells to detect only the weight of the winding roll 7, of the supports and of the fabric piece.

Advantageously, it could be provided for suitable support elements 39, analogous to those described in the second embodiment, in order to protect such load cells 12.

As can be seen from FIGS. 7 and 9, the machine is advantageously provided with three traction rolls 8, preferably located on the same horizontal plane as the winding roll 7, between which the fabric piece is introduced before reaching the winding roll 7. The vertical pulling strength determined by the fabric piece during its manufacturing stage is thus unloaded onto the traction rolls 8. It can thus be avoided that said pulling strength is transmitted to the winding roll 7, which would affect the weight detected by the load cells 12.

Moreover, at least one of sand winding rolls 7 or traction rolls 8 can be provided with two circumferential grooves 44 carried out on the outer edges of the folded fabric piece. Advantageously, as shown in FIG. 7, the central traction roll 8, i.e. the one absorbing the pulling strength of the piece, is provided with grooves 44 on its ends and on the outer edges of the folded fabric piece. These grooves allow to avoid the formation of a permanent fold in the folded tubular fabrics on their edges.

The working of an apparatus according to the invention, which has been described above mainly from the structural point of view, is the following.

In the first case the load cell 12 continuously detects the weight it supports by means of the sliding portion 17 of the support unit 16. In the second case the cell directly detects the weight of one of the upper portions 9*a* of the pair of pillars 9. In the third and preferred form of embodiment the load cell directly detects only the weight of the winding roll 7, of the end supports 43 and of the piece.

In all the embodiments shown the detected weight increases with the piling up of the fabric piece on the winding roll 7. The value of such weight is transmitted from the load cell 12 to the PLC 13 by means of a signal constituted by an electric voltage. This voltage is compared within the PLC with a preset reference voltage, corresponding in practice to the desired weight the fabric piece should have after manufacturing.

When the measured weight reaches a threshold value, the display shows the operator the weight progression so as to simplify its control.

When the voltage coming from the weight sensor 12 gets near the value of said reference voltage, the PLC sets the procedure required to stop the textile machine so that the latter stops production exactly on reaching the pre-established weight by the fabric piece formed. It is now possible to carry out a new more precise weight measurement with the machine in a still status and possibly to provide a further advancement of said piece until the desired value is reached.

The detected weight and any other information sent to the PLC by the sensors of the machine and/or set by the operator, such as moisture, the kind of yarn used, possible interruptions of production corresponding to manufacturing defects, are immediately written down on adhesive cards issued by the printer 15.

Obviously, the calculation and setting of the desired fabric eight should consider the tare, constituted by the weight of all the parts resting on the weighing device, from which—though only in the first two embodiments—the weight corresponding to the pulling strength exerted by the needle bed onto the piece should be subtracted.

It is obviously possible to provide for other embodiments of the present invention. For instance, the weight sensor 12 can be located in such a position as to detect loads exerted onto the connecting arms 6*a*, thus weighing a hanging load.

The present invention can advantageously and similarly be applied also to a loom 45 or any other textile machine for which it could be useful to weigh the yarn or fabric produced in the manufacturing process.

Figure 11:
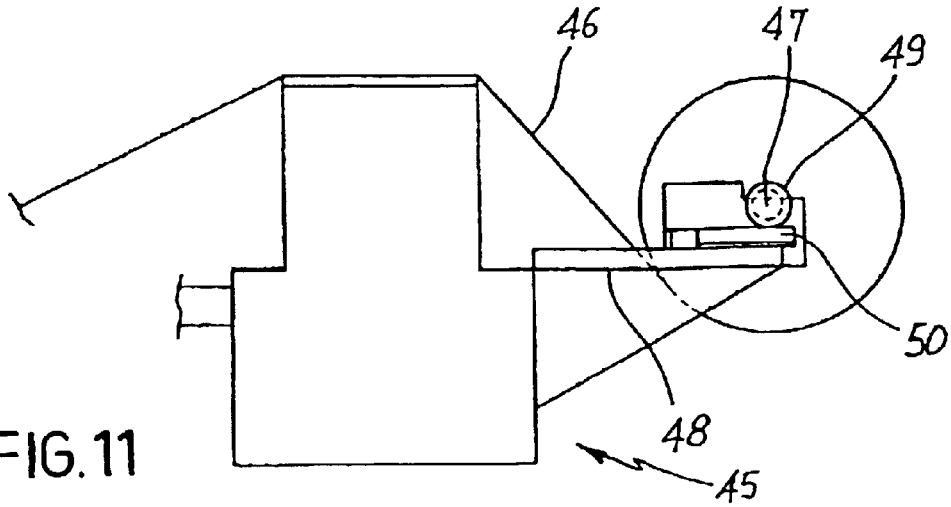
FIG. 11 shows a schematic of a loom containing an apparatus according to the present invention.

As can be seen from FIG. 11, a fabric piece 46 is produced with the loom 45, said piece being wound around a winding roll 47 supported on its end supports 49 by a pair of support arms 48.

Also in this case load cells 50 implementing an apparatus for controlling the piece weight are placed between the support arms 48 and the end supports 49 of the winding roll 47.

The invention implements a new method which is also an integral part of the present patent.

Said method consists in weighing each folded or wound fabric piece near the textile machine manufacturing said piece after the latter has been produced.

The method further provides to associate each produced piece with a printed element providing at least the information concerning the weight assigned to said piece. Advantageously, the weighing of each piece produced by a textile machine is carried out continuously, at least during the final manufacturing stage, so as to compare the detected weight, increasing during manufacturing and pick-up of said piece, with a pre-established reference weight.

It is preferably provided for a display located near the machine, which shows the progression of the weight when it reaches a first reference value.

The textile machine is stopped when the detected weight reaches said pre-established value.

Since during the working of the machine the weight measurement is slightly different from the measurement with the machine in a still status, in order to get a more precise measurement it is advantageously possible to provide a first machine stop on reaching a pre-established weight value near the desired one. After said measurement is carried out the machine is re-started until the desired weight, which can be further checked with the machine in a still status, is reached.

The invention has important advantages.

First of all, the weight of each piece corresponds with a high degree of precision to the pre-established weight, since the latter and no other parameters defines the end of the manufacturing and folding or winding stages of said piece.

It should be pointed out that the cards identifying each piece according to its weight and other parameters deemed as necessary to distinguish it are immediately available at the end of its manufacturing and can therefore be applied onto said piece, thus avoiding mistakes and information exchanges among different pieces.

It should further be pointed out that the continuous weighing of each piece during its manufacturing can be used for a remote monitoring of production for several textile machines, so as to know exactly in real time the quantity and kind of produced material.

Moreover, said information, suitably processed, can be used for storehouse control and for the related certification forms.

Other important advantages can be obtained, in particular, in the preferred embodiment of the invention, shown in FIGS. 7, 8 and 9.

First of all, as a matter of fact, a great improvement in weighing precision and reliability can be pointed out, due to tare reduction, the tare consisting only of the winding roll 7 and of its supports, and to the elimination of the vertical pulling strength of the piece which had to be subtracted from the tare weight.

Moreover, the preferred embodiment of the invention simplifies the process of removal of the loaded winding roll 7 and its replacement with another roll, thus simplifying the operator's intervention and making it possible to place a pick-up trolley directly under the roll and possibly to automate said operation.

A further advantage of the present embodiment is a reduction of permanent folds on the edges of tubular fabric, since thanks to suitable grooves 44 made on the traction rolls 8, the usual flattening of said edges can be avoided. A final advantage of the preferred embodiment is the possibility to obtain machines with reduced height, thanks to the fact that the winding roll and the traction rolls are on the same horizontal plane instead of being on the same vertical plane. This greatly simplifies the visual check of the process carried out in the machine by the operator, since the introduction of the yarns into the cylinder is executed at such a height as to be visually accessible also to short people.

In practice, the weighing apparatus according to the invention allows to improve the handling of products of textile machines from an operational and organizational point of view, thus simplifying the various operating stages and reducing execution times.

What is claimed is:

1. An Apparatus for controlling the weight of fabric produced by a textile machine, said textile machine being of the type comprising a pick-up unit (6) for a folded or wound fabric piece characterized in that the apparatus comprises:

weighing means (11) for providing a value of weight for each fabric piece associated with the textile machine (2) dedicated to manufacture of said piece;

said weighing means comprising at least a weight sensor (12) detecting the weight reached by said piece during its manufacturing and pick-up stages, operatively connected to an electronic control group (13) to check functionality of the textile machine; and a support unit (16) consisting of at least a vertically sliding portion (17) supporting said pick-up unit (6) and a surface **(17*a*) operatively contacted with said weight sensor (12), and a fixed base (18) defining a guide for said sliding portion (17)**.

2. Apparatus according to claim 1, characterized in that said vertically sliding portion (17) of the support unit (16) comprises:

a support base (20) connected to the pick-up unit (6) and turning together with the latter integrally with a needle bed (5) of the textile machine (2), a slide (21) slidably connected in vertical direction to said fixed base (18), and turning coupling means (22) around the vertical turning axis (4) of the pick-up unit (6) placed between said support base (20) and said slide (21).

3. Apparatus according to claim 2, characterized in that said support base (20) connected to the pick-up group (6) shows in its lower portion a vertical support shaft (23), and in that said turning coupling means (22) are connected to said vertical shaft (23) and suitable to support the axial load exerted onto said shaft.

4. Apparatus according to claim 3, characterized in that said slide (21) is defined by a substantially glass-shaped element housing said vertical support shaft (23) and said turning coupling means (22), said glass-shaped element showing a bottom wall defining said area **(17*a*) operatively contacted with the weight sensor (12)**.

5. Apparatus according to claim 4, characterized in that said fixed based (18) comprises a substantially bush-shaped element slidably coupled with said glass-shaped slide (21), and in that anti-rotation means (25) are placed between said bush-shaped element (18) and the slide (21), said anti-rotation means (25) suitable to transmit the vertical translation direction to said slide (21).

6. Apparatus according to claim 5, characterized in that said glass-shaped slide (21) shows on its outer portion an abutment extension **(21*a*) abutting against an upper edge (18*a*) of said bush-shaped element (18) to define a lower run end for the vertical translation of said slide (21)**.

7. Apparatus according to claim 3, characterized in that said support base (2) comprises a circular plate (28) integral in its lower portion with said vertical support shaft (23) and a pair of elongated elements (29) peripherally integral with said circular plate (28) and engaging a pair of parallel bars (10) defining the base of said pick-up unit (6).

8. Apparatus according to claim 1, characterized in that said weight sensor (12) consists of a load cell showing a flexible wall **(12*a*) in contact with said sliding portion (17) of the support unit (16)**.

9. An Apparatus for controlling the weight of fabric produced by a textile machine, said textile machine being of the type comprising a pick-up unit (6) for a folded or wound fabric piece characterized in that the apparatus comprises:

weighing means (11) for providing a value of weight for each fabric piece associated with the textile machine (2) dedicated to manufacture of said piece;

a winding roll (7) to pick up the piece;

at least a pillar (9) divided into an upper portion **(9*a*) supporting said winding roll (7), and a lower portion (9*b*)**;

a support element (39) integral with said lower portion **(9*b*) and placed so as to support said upper portion (9*a*) instead of said weighing means (11)** when the weight is over a given safety value;

said weighing means (11) being operatively placed between said upper portion **(9*a*) and said lower portion 9(*b*)**.

* * * * *